US005460484A

United States Patent [19]

Yagi

[11] Patent Number: 5,460,484

[45] Date of Patent: Oct. 24, 1995

[54] AIR FLOW GUIDING MECHANISM FOR COMPRESSOR INLET

[75] Inventor: Yoichi Yagi, Yokohama, Japan

[73] Assignee: Nissan Motor Co., Ltd., Yokohama, Japan

[21] Appl. No.: 247,224

[22] Filed: May 23, 1994

[30] Foreign Application Priority Data

May 26, 1993 [JP] Japan ..... 5-124240

[51] Int. Cl.[6] ..... F04D 29/66

[52] U.S. Cl. ..... 415/161; 415/162; 415/163

[58] Field of Search ..... 415/160, 161, 415/162, 163

[56] References Cited

U.S. PATENT DOCUMENTS

| | | | |
|---|---|---|---|
| 2,351,516 | 6/1944 | Jandasek | 415/161 X |
| 3,169,747 | 2/1965 | Seymour | 415/161 |
| 4,436,481 | 3/1984 | Linder | 415/163 |
| 4,439,104 | 3/1984 | Edmonds | 415/161 |
| 4,451,356 | 7/1985 | Linder | 415/163 |
| 4,844,695 | 7/1989 | Banks et al. | 415/161 X |
| 4,877,370 | 10/1989 | Nakagawa et al. | 415/208.4 |
| 5,165,849 | 11/1992 | Nakagawa et al. | 415/161 |

FOREIGN PATENT DOCUMENTS

| | | | |
|---|---|---|---|
| 58-48703 | 3/1983 | Japan | 415/119 |

OTHER PUBLICATIONS

Advanced Gas Turbine (AGT) Technology Development Project, Phoenix, Ariz., Dec. 1987.

*Primary Examiner*—Edward K. Look
*Assistant Examiner*—Michael S. Lee
*Attorney, Agent, or Firm*—Foley & Lardner

[57] ABSTRACT

The invention relates to a compressor provided with an impeller having a rotating shaft for the purpose of compressing air, and an air inlet having a circular cross-section centered on the rotating shaft so as to provide air for the impeller. Further provided are a plurality of movable vanes respectively pivoted in the inlet near the outer circumference of the circular cross-section, a mechanism for tilting these vanes, and a mechanism for causing a specific movable vane to project further downstream than the other movable vanes. When a circular flow is set up in the air inlet by the movable vanes, Karman vortices are produced from the rear ends of the vanes, and when the phases of these vortices combine together, noise is generated. A specific movable vane, the rear end of which projects further downstream than those of the other vanes, disrupts and interferes with the phase combination of the Karman vortices produced by the other vanes, and thereby prevents noise. As the specific vane tilts in the same direction as the other vanes, the vanes do not mutually interfere, consequently the vanes may be positioned at any desired interval apart. The tilt limits and direction may be freely set.

10 Claims, 12 Drawing Sheets

AIR FLOW GUIDING MECHANISM FOR COMPRESSOR INLET

FIELD OF THE INVENTION

This invention relates to movable vanes installed in the air inlet passage of a compressor for the purpose of guiding the air flow, and more specifically, to a means of preventing noise generated by these movable vanes.

BACKGROUND OF THE INVENTION

Automobile gas turbine engines have to cover a wide range of engine speeds from high to low, and in order to maintain acceleration performance when the engine is started, the idle running speed of the engine should preferably be high. In the Final Report (NASA CR-1808941) of the Advanced Gas Turbine (AGT) Technology Development Project, for example, the air inlet to the compressor is given a circular cross-section centered on the rotation shaft of the compressor, numerous vanes being provided on its outer circumference so as to guide inflowing air in the rotation direction of the impeller. This guided air maintains the driving horsepower of the compressor at a low level while the idle running speed is high, thereby reducing fuel costs and improving acceleration performance. The setting angle of these vanes may be modified according to the engine running conditions, the vanes being most tilted when the engine is running idle.

However, when the engine is operated with the movable vanes at a large tilt angle, noise in the frequency range 700–750 Hz is produced by the vanes. This is thought to be due to the combination of Karman vortices with disordered phases from the ends of the vanes, leading to the generation of acoustic standing waves. The noise occurs in a range above a certain air flowrate and above a certain vane tilt angle.

To combat this problem, according to the previous report, flat tabs adjacent to certain of the movable vanes were arranged to project into the air inlet. These tabs were provided at two locations separated by a 180 degree interval. The effect of the tabs is to disturb the Karman vortices produced by adjacent vanes, preventing phase addition and hence the generation of acoustic standing waves.

However, to prevent the movable vanes adjacent to the side of the tabs from interfering with the tabs, the interval between the vanes has to be increased. Further, if the direction of the induced air flow is reversed, the movable vanes adjacent to the tabs interfere with the tabs. In other words, the provision of tabs adjacent to the vanes placed severe limitations on the interval between the vanes and the range of possible vane tilt angles, and impaired freedom of design of the compressor inlet.

SUMMARY OF THE INVENTION

It is therefore an object of this invention to prevent noise without limiting the interval between the movable vanes or the range of possible vane tilt angles.

In order to achieve the above object, this invention provides an air flow guiding mechanism for such a compressor that comprises a rotating shaft, an impeller rotating about the shaft for the purpose of compressing air, and an air inlet having a circular cross-section centered on the shaft for guiding air from outside the compressor toward the center and into the impeller. The mechanism comprises a plurality of movable vanes respectively pivoted in the inlet near the outer circumference of the circular cross-section and a mechanism for tilting the movable vanes. The vanes are supported together in a tilted state by the tilting mechanism and a specific movable vane is set to project further downstream than the other movable vanes by a predetermined amount, either by arranging the specific movable vane to have a tilt angle smaller than that of the other movable vanes or by arranging the specific movable vane to have an length greater than that of the other movable vanes. In the later case, the specific movable vane may be provided with an extension bent in the direction of the shaft.

Preferably, the projection of the specific movable vane in the direction of the shaft is set greater than that of the other movable vanes by approximately 40%.

This invention provides another air flow guiding mechanism for such a compressor that comprises a rotating shaft, an impeller rotating about the shaft for the purpose of compressing air, and an air inlet having a circular cross-section centered on the shaft for guiding air from outside the compressor toward the center and into the impeller. The mechanism comprises a plurality of movable vanes respectively pivoted in the inlet near the outer circumference of the circular cross-section, a mechanism for tilting the movable vanes, and a tab situated at a predetermined distance downstream of the rear end of a specific movable vane.

The tab may be tilted at a predetermined angle in the same direction as that of the movable vanes with respect to the center line of the inlet passing through the shaft.

Preferably, the area of the tab is approximately 30% of the area of the movable vane.

The details as well as other features and advantages of this invention are set forth in the remainder of the specification and are shown in the accompanying drawings.

DESCRIPTION OF THE PREFERRED EMBODIMENTS

Figure 2:
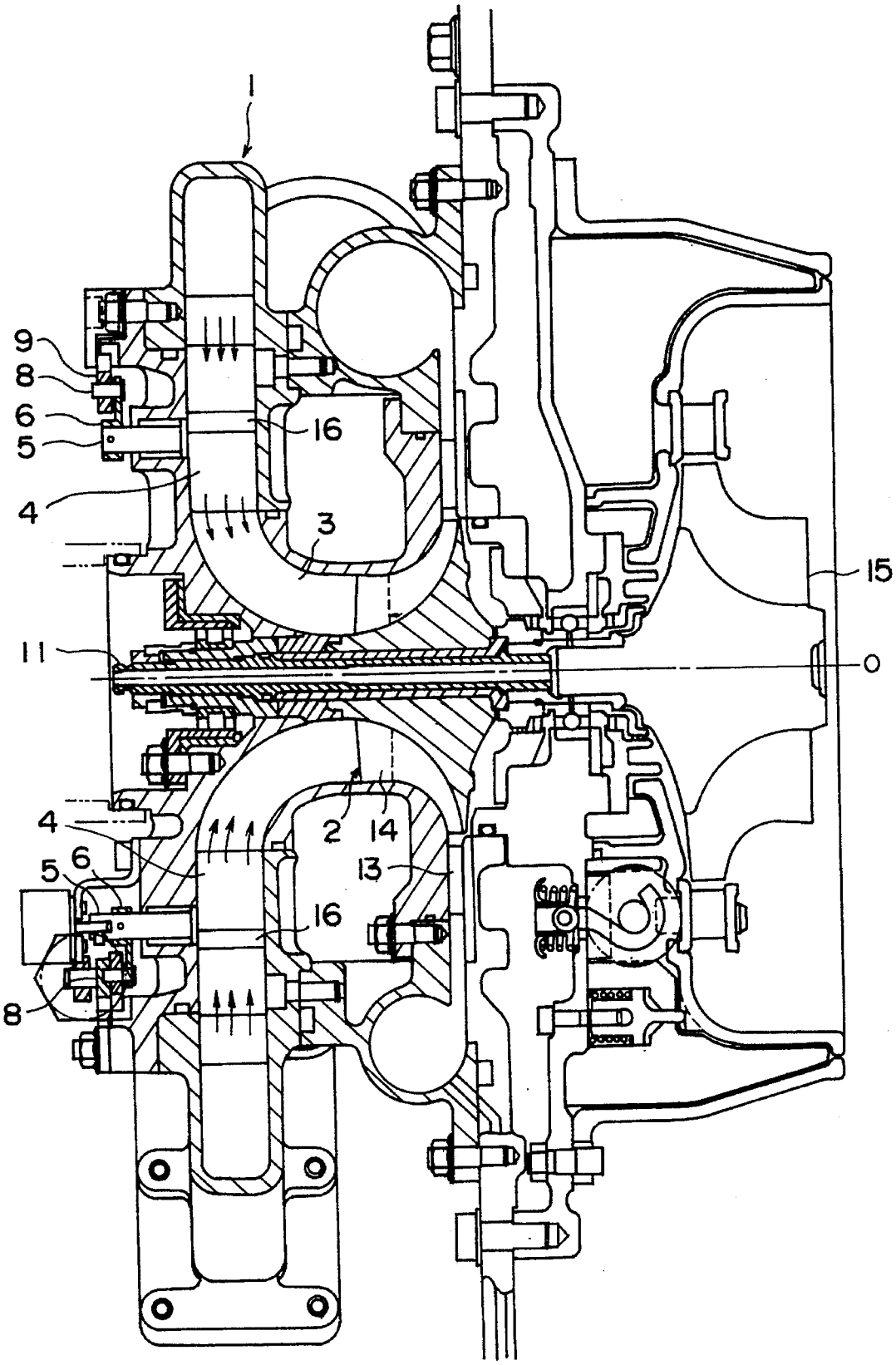
FIG. 2 is a vertical sectional view of a compressor according to the first embodiment.

Referring to FIG. 2 of the drawings, a compressor 1 is provided with an impeller 2 connected to a rotation shaft 11, and an impeller drive turbine 15. Air compressed by the compressor 1 is sent to a burner, not shown, where it burns fuel, and the combustion gases rotate the turbine 15 and an output turbine, not shown.

When the impeller 2 rotates, air flowing toward the impeller 2 from an inlet 3 changes its direction to the radial direction between vanes 14 of the impeller 2, and after being compressed by centrifugal force, is sent to the burner from a diffuser 13.

In the inlet 3, a plurality of sets of fixed vanes 16 and movable vanes 4 are arranged in a circumferential direction at a predetermined interval apart. The upstream fixed vanes 16 are arranged radially on the same circumference with respect to the rotation center O of the impeller 2. Likewise the movable vanes 4, which are also arranged radially, project downstream from the rear ends of the fixed vanes 16. The air passing through the fixed vanes 16 and the movable vanes 4 is given an initial rotation by tilting the movable vanes 4 with respect to the fixed vanes 16 according to the engine running conditions.

Figure 1:
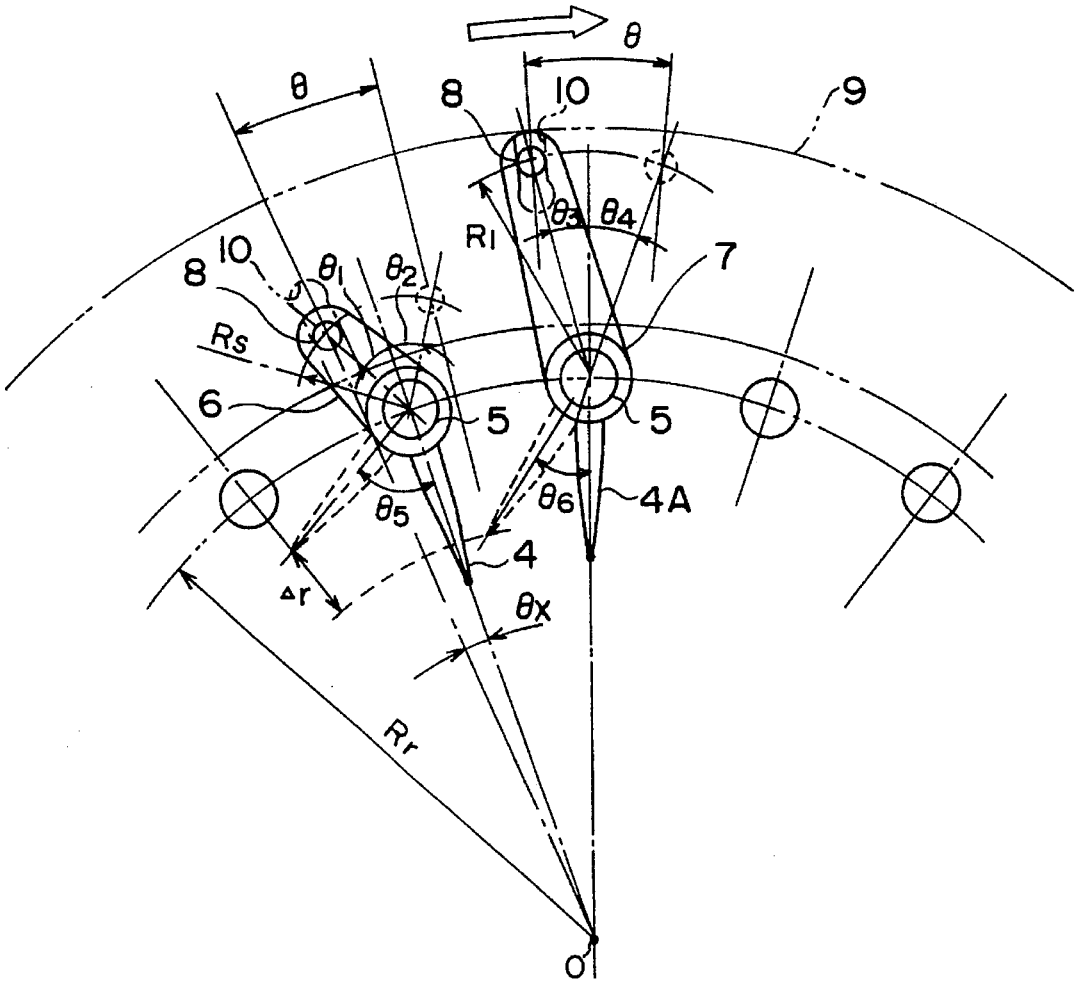
FIG. 1 is a side view of a part of an air flow guiding mechanism according to a first embodiment of this invention.

As shown in FIG. 1, levers 6 or 7 are fixed on the tilt axes of the movable vanes 4 so as to tilt the vanes 4 synchronously. The levers 6 and 7 are respectively connected to a ring 9 via pins 8. A guide groove 10 engaging with the pins 8 is formed in the ring 9. By means of this arrangement, when one movable vane 4 is tilted by an actuator, not shown, all the movable vanes 4 tilt via the ring 9.

One of the movable vanes 4, a specific vane 4A, is connected to the ring 9 via the lever 7, the other movable vanes 4 being connected to the ring 9 via the lever 6. The length Rl of the lever 7 is set to be longer than the length Rs of the lever 6 so that the tilt angle of the vane 4A is different from, and less than, the tilt angle of the other vanes 4. As a result, the rear end of the specific vane 4A projects further downstream than the rear ends of the other vanes 4, i.e. it projects towards the rotation center O, when the vanes are tilted. This projecting part disturbs Karman vortices which are produced from the rear ends of the other movable vanes 4, interferes with phase addition of Karman vortices, and thereby prevents generation of noise.

If Rr is the distance between the rotation center O of the impeller 2 and the tilt axis 5 of the lever 6, Rs is the distance between the tilt axis 5 and the pin 8 of the lever 6, $\theta_1$ and $\theta_2$ are angles made by the lever 6 with respect to the line joining the tilt axis 5 and the rotation center O before and after the ring 9 rotates through an angle θ, θx is an angle made by the pin 8 and tilt axis 5 of the lever 6 enclosing the rotation center O after the ring 9 has rotated, $Rx_1$ is the distance from the rotation center O of the impeller 2 to the pin 8 of the lever 6 after rotation, $Rx_2$ is the distance from the rotation center O of the impeller 2 to the pin 8 of the lever 7 after rotation, the following trigonometric relations exist:

$$Rx_1^2=Rr^2+Rs^2-2**Rr*Rs*\cos(180°-\theta_1)$$

$$Rs^2=Rx^2+Rr^2-2*Rx*Rr*\cos\theta x$$

$$\Delta\theta=|\theta-\theta x|$$

$$Rs^2=Rx_2^2+Rr^2-2*Rx_2*Rr*\cos\Delta\theta$$

$$Rx_2^2=Rs^2+Rr^2-2*Rs*Rr*\cos(180°-\theta_2)$$

The tilt angle of the lever 6, i.e. the setting angle of a movable vane 4, is given as $\theta_1+\theta_2$ if θ>θx, and by $\theta_1-\theta_2$ if θ<θx.

Further, if $\theta_3$ and $\theta_4$ are angles made by the lever 7 with respect to the line joining the tilt axis 5 and the rotation center O before and after the ring 9 rotates through an angle θ, θx is the angle made by the pin 8 and tilt axis 5 of the lever 7 enclosing the rotation center O after the ring 9 has rotated, and Rl is the distance between the tilt axis 5 and the pin 8 of the lever 7, the following trigonometric relations exist:

$$Rx_1^2=Rr^2+Rl^2-2*Rr*Rl*\cos(180°-\theta_2)$$

$$Rl^2=Rx^2+Rr^2-2*Rx*Rr*\cos\theta x$$

$$\Delta\theta=|\theta-\theta x|$$

$$Rl^2=Rx_2^2+Rr^2-2*Rx_2*Rr*\cos\Delta\theta$$

$$Rx_2^2=Rl^2+Rr^2-2*Rl*Rr*\cos(180°-\theta_4)$$

The tilt angle of the lever 7, i.e. the setting angle of a specific vane 4A, is given as $\theta_3+\theta_4$ if θ>θx, and by $\theta_3-\theta_4$ if θ<θx.

The values of $\theta_1$, $\theta_3$, Rs, Rl and Rr vary according to the layout of the movable vanes 4, 4A, and the levers 6,7. If $\theta_1$=30°, $\theta_3$=15°, Rs=15 mm, Rl=30 mm, Rr=74 mm, and the rotation angle θ of the ring 9 is 10°, the setting angle $\theta_1+\theta_2$ of the lever 6 is 60.9° and the setting angle $\theta_3+\theta_4$ of the lever 7 is 34.6°. noise was generated when the length Rr of the lever 6 was fixed, and the length Rl of the lever 7 was varied. From these results, it is seen that as the setting angle of the specific vane 4A is increased from 0° , the region in which noise is not generated becomes narrower. For example, when the setting angle of the specific vane 4A is 0°, no noise is generated even if the tilt of the vanes 4 is increased to 51°. On the other hand, when the setting angle of the specific vane 4A is 10°, no noise is generated when the vanes 4 are tilted up to 45°.

As the specific vane 4A decreases the rotation angle of the air flow and increases pressure loss, it is preferable that its setting angle is as near as possible to that of the other movable vanes 4 within the region wherein noise is not generated. In this manner, pressure loss may be reduced and the beneficial effect of initial rotation maintained while preventing noise generation at the same time.

According to this embodiment, there is only one specific movable vane 4A having a different setting angle from the other movable vane 4. The number of these specific vanes 4A may however be increased to two or three, and although this leads to a greater pressure loss, it provides an enhanced effect in preventing noise generation.

As in the above embodiment, the specific movable vane 4A tilts in the same direction as the other movable vanes 4, there is no risk of the vane 4A touching one of the neighboring vanes 4 even if the interval between the vanes 4 is made narrow, and the setting angle of the vanes 4 is increased. The air may therefore be given a strong initial rotation. Moreover, as there are no tabs of the kind described in the prior art, the movable vanes 4 may be tilted in any direction, even in the direction that makes the inflowing air rotate in the opposite direction to that of the impeller 2.

Figure 4:
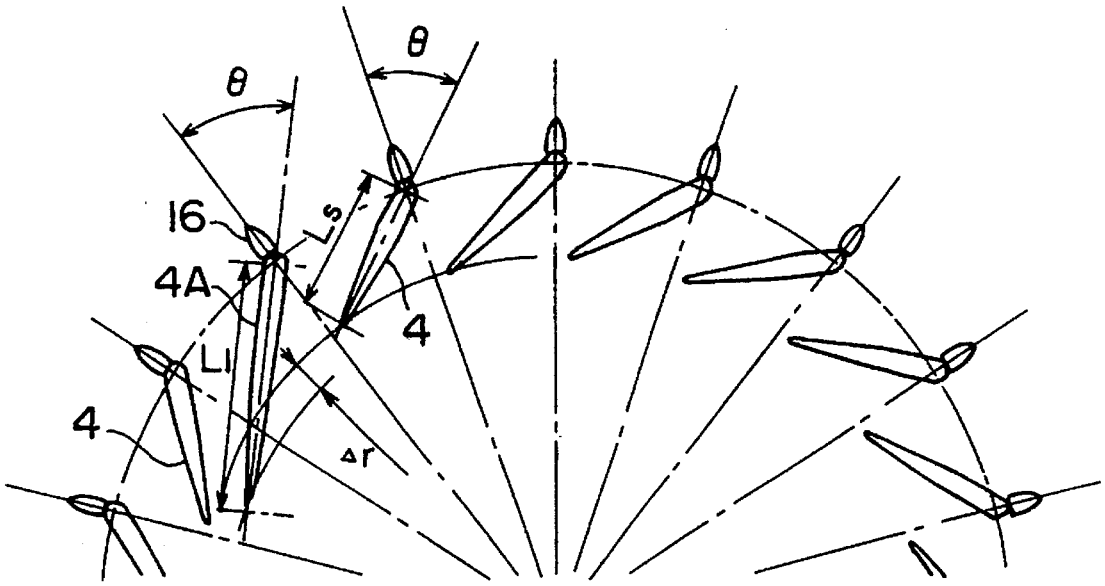
FIG. 4 is a side view of a part of an air flow guiding mechanism according to a second embodiment of this invention.

FIG. 4 shows a second embodiment of this invention. In this embodiment, all of the movable vanes 4 have the same setting angle, and the length Ll of a single specific vane 4A is arranged to be approximately 40% longer than the length Ls of the other vanes 4. The set tilt angle θ of the specific vane 4A and of the other vanes 4 is the same.

According also to this embodiment, the rear end of the specific vane 4A projects further downstream than the rear ends of the other vanes 4 towards the center. This disturbs Karman vortices which are produced from the other vanes 4, and interferes with phase addition of Karman vortices so as to prevent generation of noise.

In FIG. 1, if the setting angle of the specific vane 4A is $\theta_6$, the setting angle of the other vanes 4 is $\theta_5$, the length of a vane 4 is Ls, and the amount by which the specific vane 4A projects beyond the other vanes 4 toward the center is Δr, a projection factor of the vane 4A toward the center is given by the following relation:

$$\Delta r/Ls=\cos\theta_6-\cos\theta_5$$

Figure 3:
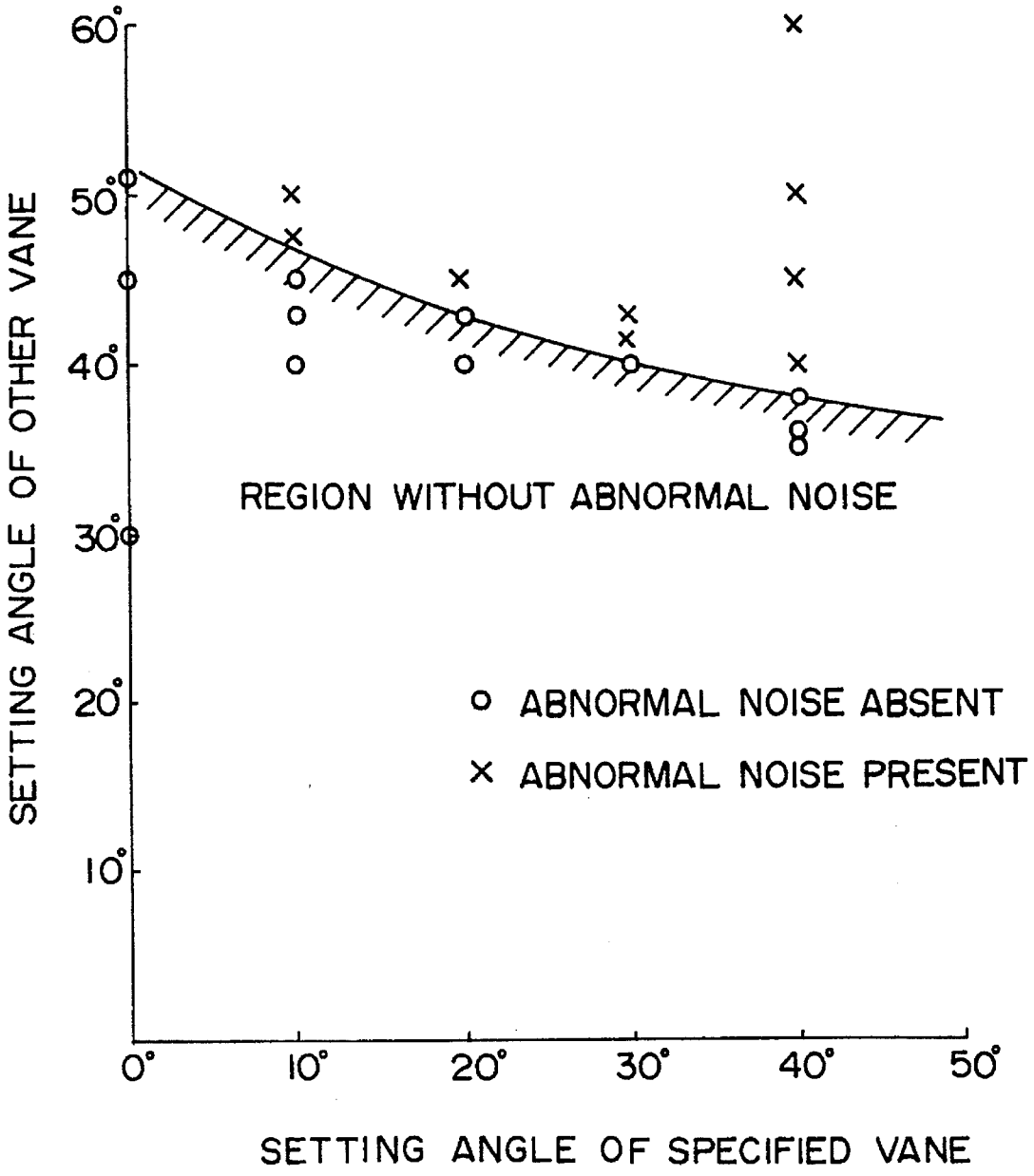
FIG. 3 is a graph showing an experimental relationship between a tilt angle of a specific movable vane and a noise generated, according to the first embodiment.
Figure 5:
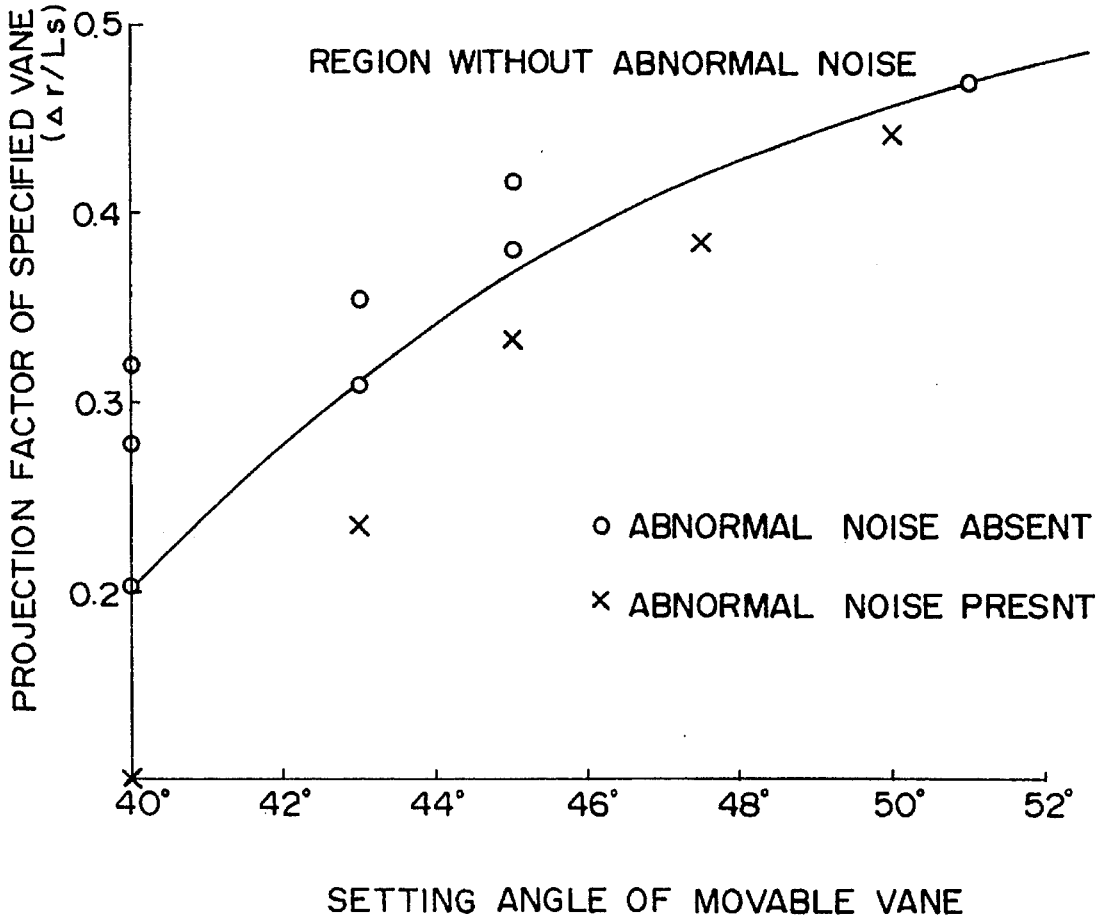
FIG. 5 is a graph showing an experimental relationship between a tilt angle of a specific movable vane and a noise generated, according to the second embodiment.

The graph of FIG. 5 shows the relation between the variation of Δr/Ls and noise generation based on the experimental results shown in FIG. 3.

From this data, it is seen that when the setting angle θ of the movable vanes 4 is at a maximum of approximately 45°, noise can be prevented if the specific movable vane 4A projects approximately 40% further toward the rotation center O than the other movable vanes 4.

According to the second embodiment, therefore, the specific vane 4A has been made longer than the other movable vanes 4 by approximately 40%. Moreover, as in the first embodiment, if the number of specific vanes 4A is increased, pressure loss increases but noise prevention is enhanced.

Figure 6:
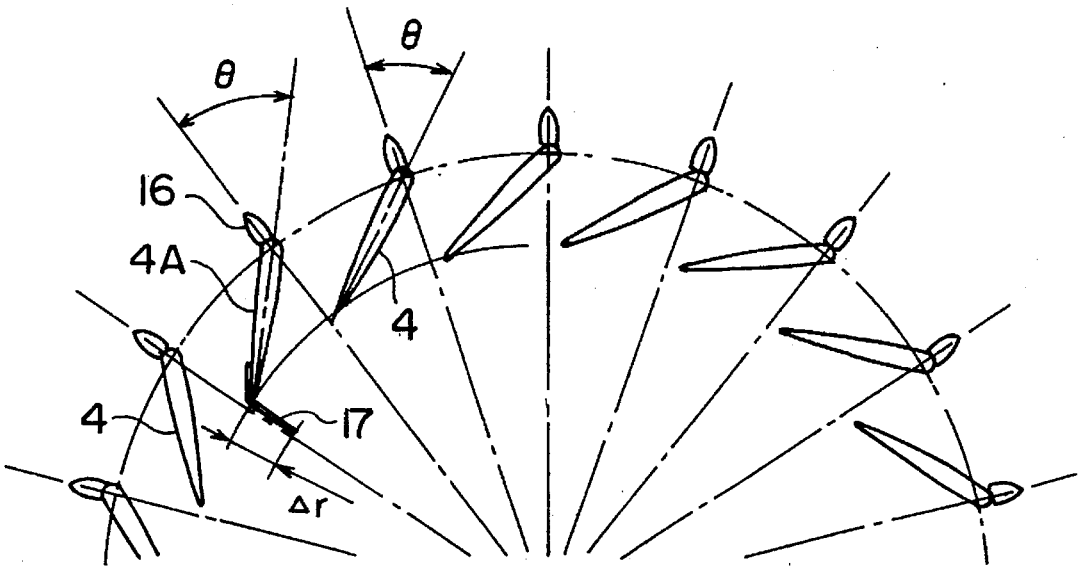
FIG. 6 is a side view of a part of an air flow guiding mechanism according to a third embodiment of this invention.

FIG. 6 shows a third embodiment of this invention. According to this embodiment, the setting angles of all the movable vanes 4, 4A are identical to those of the second embodiment, and an auxiliary vane 17 is fixed to the rear end of the specific vane 4A.

The auxiliary vane 17 is bent at a predetermined angle, and the vanes 4 project downstream toward the center O by a predetermined amount. According to this embodiment, the same effect is obtained as in the first and second embodiments.

Figure 7:
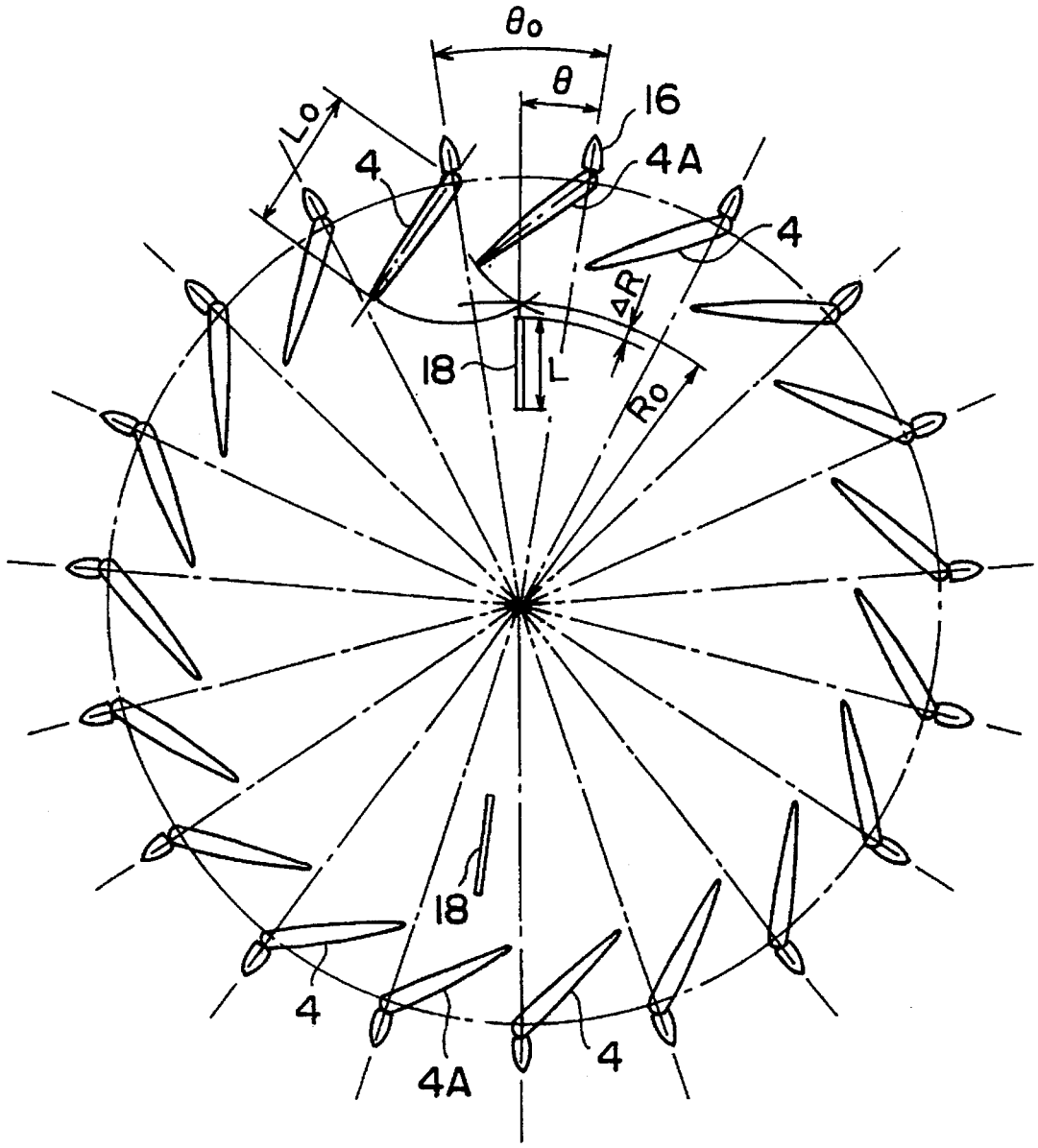
FIG. 7 is a side view of an air flow guiding mechanism according to a fourth embodiment of this invention.
Figure 8:
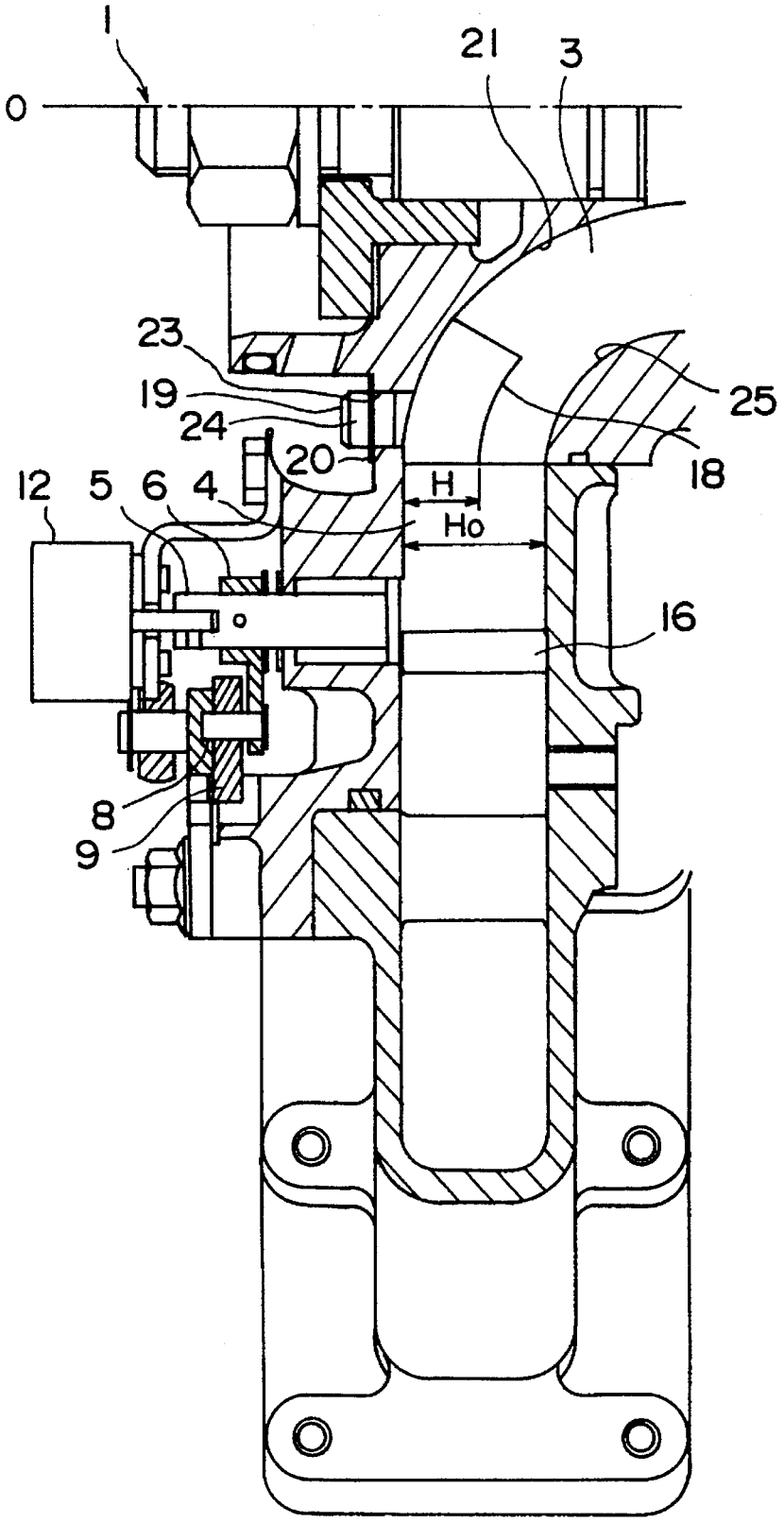
FIG. 8 is a sectional view of a part of the compressor taken along a rotation shaft showing a disposition of tabs according to the fourth embodiment.

FIG. 7 shows a fourth embodiment of this invention. In the figure, the shapes, dimensions and setting angles of all the movable vanes 4, 4A are identical, and a tab 18 is provided downstream of the specific movable vane 4A. The tab 18 is installed on one wall 21 of the inlet 3 as shown in FIG. 8. A shaft 19 is fixed to the rear of the tab 18, the shaft 19 being inserted in a hole 23 formed in the wall 21 and retained by an snap ring 24 so as to fix the tab 18 to the wall 21. The tab 18 may also be fixed to a wall 25 in the opposite side.

The length L of the tab 18 is set such that its ratio to the length $L_0$ of a movable vane 4, $L/L_0$, is of the order of 0.6. The height H of the tab 18 is set such that its ratio to the vane width HO, H/HO, is of the order of 0.5. The area of the tab 18 is then approximately 30% of that of a movable vane 4.

In this case, the tab 18 which is positioned downstream of the specific movable vane 4A disturbs the Karman vortices produced from the rear end of the movable vanes 4, and the noise generated by the phase addition of Karman vortices is prevented. As the tab 18 is installed at a position removed from the movable vane 4A, it does not restrict the rotation range of the vanes 4, 4A as in the prior art device mentioned hereinabove, and the vanes 4, 4A may therefore also be tilted in the reverse direction.

Figure 9:
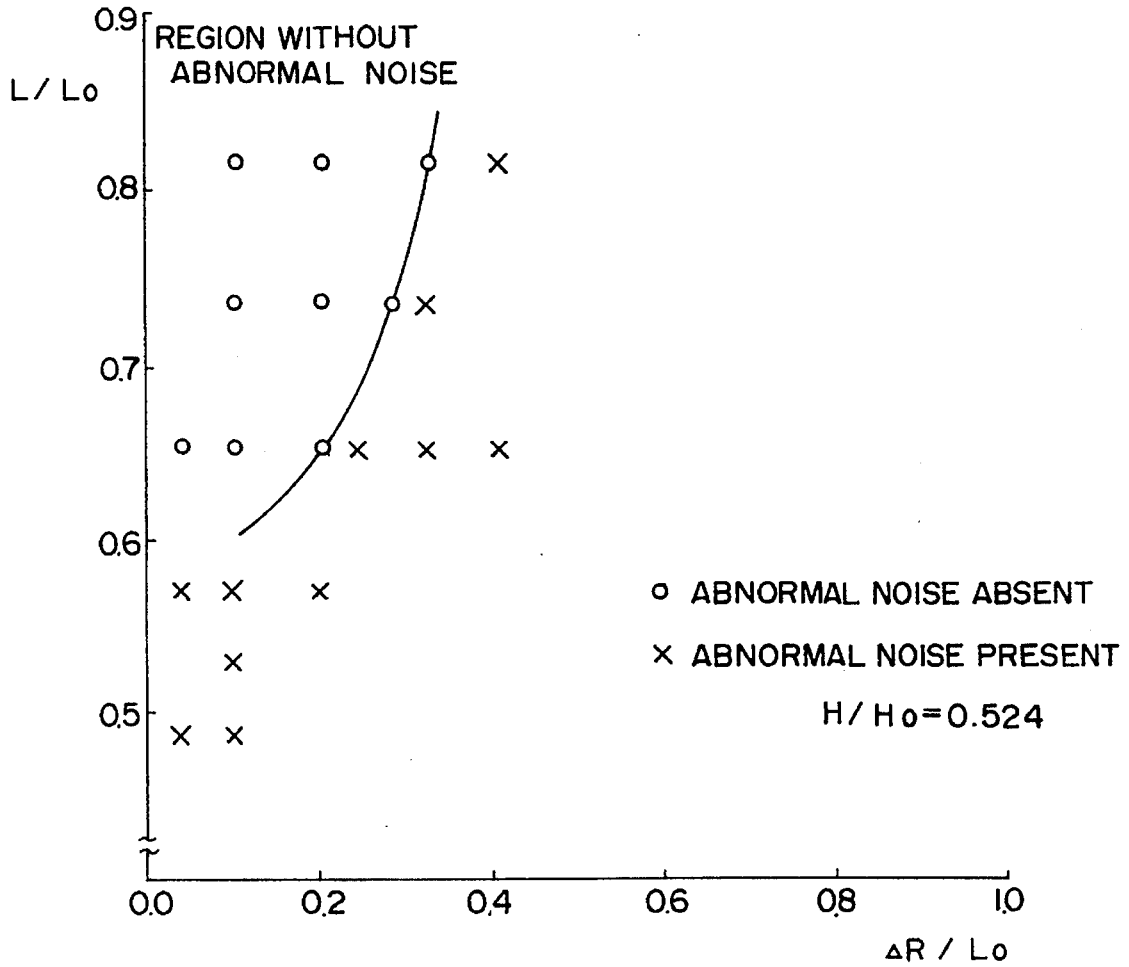
FIG. 9 is a graph showing an experimental relationship between an interval $\Delta R$ separating the tabs and movable vanes, and a noise generated, according to the fourth embodiment.

The graph in FIG. 9 shows experimental results concerning noise generation when the distance ΔR from the radius $R_0$ corresponding to the rotation range of the vanes 4, 4A to the edge of the outer circumference of the tab 18, the ratio $\Delta R/L_0$ of this distance to the length $L_0$ of the vanes 4, 4A, and the ratio $L/L_0$ of the length L of the tab 18 to the length $L_0$ of the vanes 4, 4A, are varied. From these experimental results, it is seen that noise occurs in the range $\Delta R/L_0>0.4$ or $L/L_0<0.6$.

Figure 10:
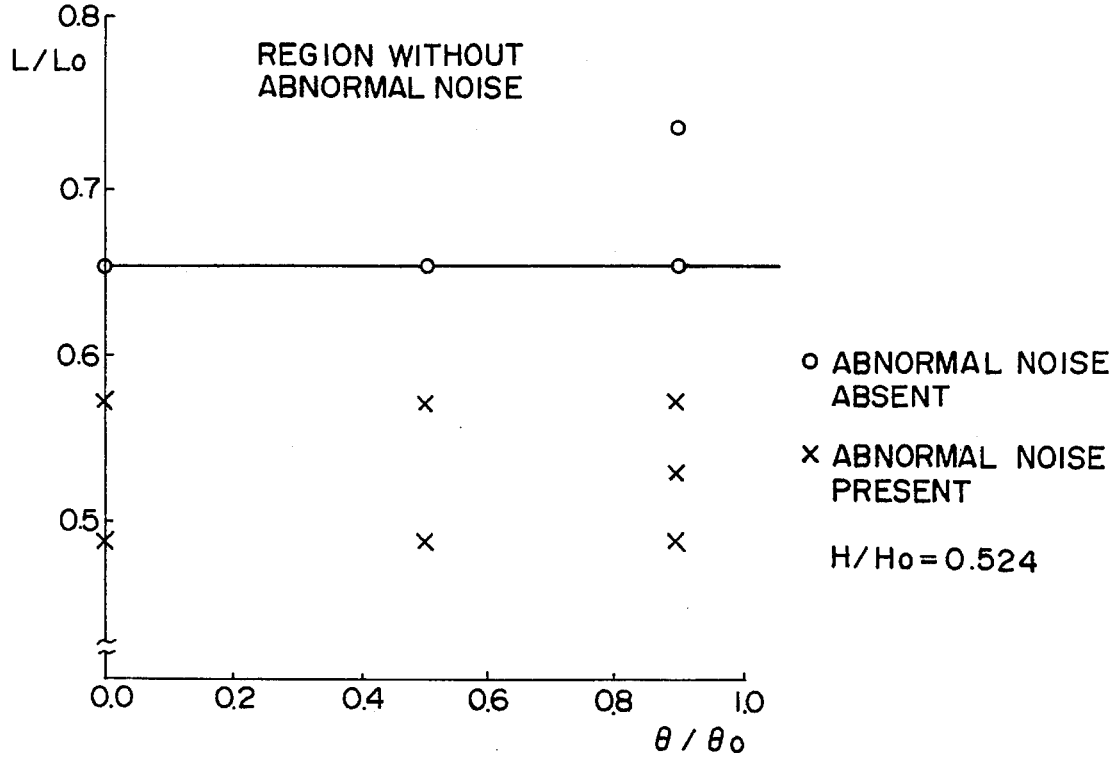
FIG. 10 is a graph showing an experimental relationship between an angle θ of installation positions of the tabs and the noise generated, according to the fourth embodiment.

The graph in FIG. 10 shows experimental results concerning how noise generation is affected when the ratio $\theta/\theta_0$ of the setting angle θ of the tab 18 to the pitch angle $\theta_0$ of the vanes, 4, 4A, and the ratio $L/L_0$ of the length L of the tab 18 to the length $L_0$ of the vanes 4, 4A, are varied. From these experimental results, it is seen that noise occurs in the range $L/L_0<0.6$, and that the setting angle θ of the tab 18 has no effect on preventing noise.

Figure 11:
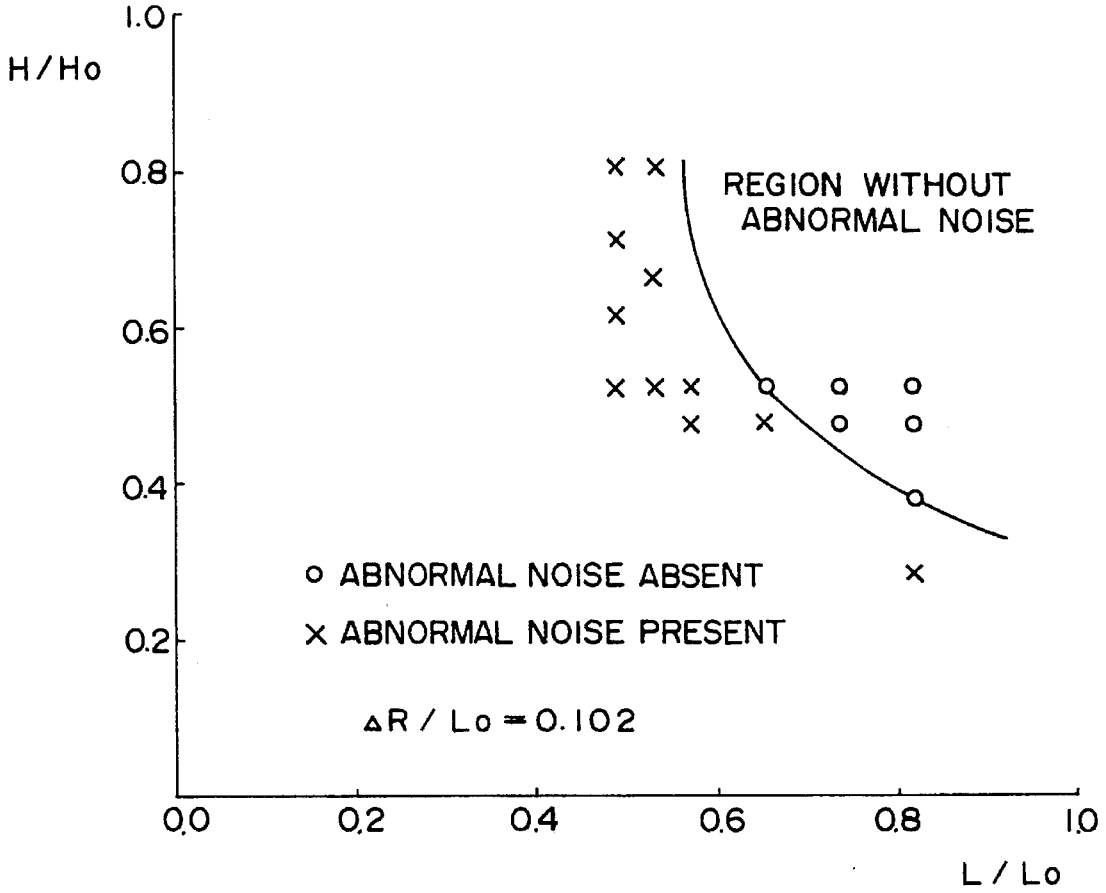
FIG. 11 is a graph showing an experimental relationship between the dimensions of the tabs and the noise generated, according to the fourth embodiment.

The graph in FIG. 11 shows experimental results concerning how noise generation is affected when the ratio $H/H_0$ of the height H of the tab 18 to the width $H_0$ of the inlet 3, and the ratio $L/L_0$ of the length L of the tab 18 to the length $L_0$ of the vanes 4, 4A, are varied. From these experimental results, it is seen that when the length L of the tab 18 is long, the height H of the tab 18 required to prevent noise becomes less, and noise is produced when the area HL of the tab 18 falls below an effectively constant value. When the width of the vane 4 is equal to the width HO of the inlet, the length L of the tab 18 is within practical limits, the area of the tab 18 is constant and the critical line on which noise suppression can be obtained is experimentally represented by $(L/L_0)*(H/H_0)=0.3$; wherein ≈ means "approximately equal to."

In other words, when $L/L_0\approx0.6\sim0.8$, noise can be prevented by setting the area of the tab 18 to be of the order of 30% of that of the vane 4. The above settings according to the fourth embodiment are based on this experimental result. It should be noted that by making the tab 18 smaller to the extent that noise can be still prevented, pressure loss is reduced and the benefit of the initial rotation given to the air flow is enhanced.

According to the above embodiment, there are two tabs 18. If the number of tabs 18 is increased, pressure loss increases but the noise prevention effect is enhanced.

Figure 12:
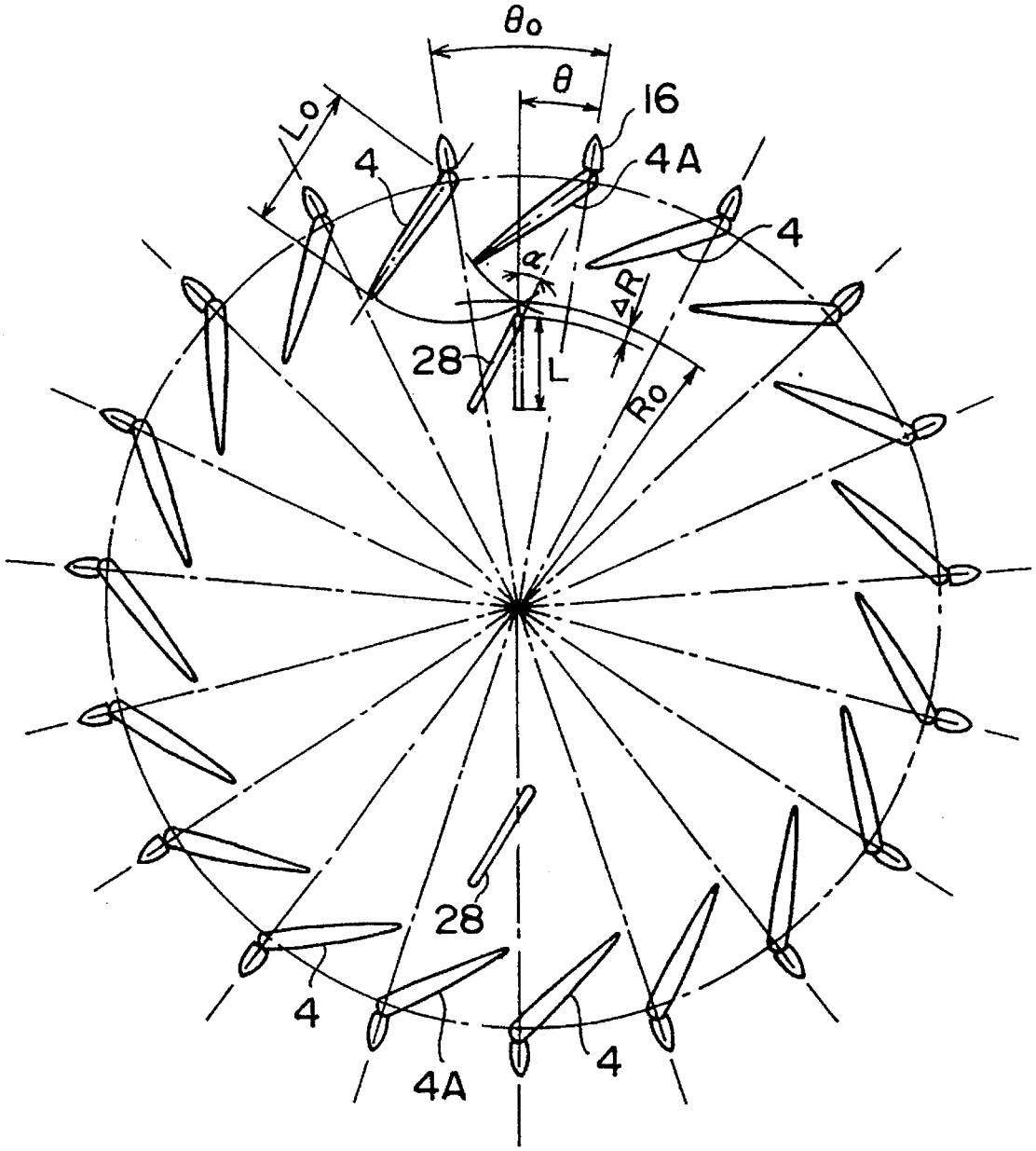
FIG. 12 is a side view of an air flow guiding mechanism according to a fifth embodiment of this invention.

FIG. 12 shows a fifth embodiment of this invention. According to this embodiment, two tabs 28 are arranged downstream of the vanes 4 as in the fourth embodiment. The tabs 28 arranged in the same direction as the tilt of the vanes 4, are tilted at an angle α with respect to the line joining the center O and the ends of the tabs 28, and are set such that their projected length on this line is L. According to this embodiment, the same effect is obtained as in the fourth embodiment.

The embodiments of this invention in which an exclusive property or privilege is claimed are defined as follows:

1. An air flow guiding mechanism for a compressor, said compressor comprising a rotating shaft, an impeller rotating about said shaft for the purpose of compressing air, an air inlet having a circular cross-section centered on said shaft for guiding air from outside said compressor toward the center and into said impeller, and a plurality of fixed vanes disposed in said air inlet, said mechanism comprises:

a plurality of movable vanes respectively pivoted in said inlet near the outer circumference of said circular cross-section and downstream of said plurality of fixed vanes, and means for tilting said movable vanes, wherein said movable vanes are supported together in a tilted state by said tilting means and a specific movable vane is set to project further downstream than the other movable vanes by a predetermined amount.

2. An air flow guiding mechanism as defined in claim 1, wherein all of said movable vanes have a constant length and said specific movable vane has a tilt angle smaller than that of the other movable vanes.

3. An air flow guiding mechanism as defined in claim 1, wherein said specific movable vane has a length greater than that of the other movable vanes.

4. An air flow guiding mechanism as defined in claim 1, wherein said specific movable vane is provided with an extension bent in a direction toward said shaft.

5. An air flow guiding mechanism as defined in claim 1, wherein a projection of said specific movable vane in a direction toward said shaft is greater than that of the other movable vanes by approximately 40%.

6. An air flow guiding mechanism for a compressor, said compressor comprising a rotating shaft, an impeller rotating about said shaft for the purpose of compressing air, and an air inlet having a circular cross-section centered on said shaft for guiding air from outside said compressor toward the center and into said impeller, said mechanism comprises:

a plurality of movable vanes respectively pivoted in said inlet near the outer circumference of said circular cross-section, means for synchronously tilting said movable vanes, and a tab situated at a predetermined distance downstream from an end of a specific movable vane, said tab being tilted at a predetermined angle in the same direction as that of said movable vanes with respect to the center line of the inlet passing through said shaft.

7. An air flow guiding mechanism for a compressor, said compressor comprising a rotating shaft, an impeller rotating about said shaft for the purpose of compressing air, and an air inlet having a circular cross-section centered on said shaft for guiding air from outside said compressor toward the center and into said impeller, said mechanism comprises:

a plurality of movable vanes respectively pivoted in said inlet near the outer circumference of said circular cross-section, means for tilting said movable vanes, and means for tilting a specific movable vane at a smaller tilt angle than the other movable vanes so as to set said specific movable vane to project further downstream than the other movable vanes.

8. An air flow guiding mechanism as defined in claim 7, wherein said specific movable vane has a length greater than that of the other movable vanes.

9. An air flow guiding mechanism as defined in claim 7, wherein said specific movable vane is provided with an extension bent toward said shaft.

10. An air flow guiding mechanism as defined in claim 7, wherein the projection of said specific movable vane in the direction of said shaft is greater than that of the other movable vanes by approximately 40%.

* * * * *